US005329568A

United States Patent [19]

Buehler et al.

[11] Patent Number: 5,329,568

[45] Date of Patent: Jul. 12, 1994

[54] X-RAY GENERATOR WITH X-RAY TUBE VOLTAGE REGULATION FOR MAINTAINING THE X-RAY TUBE CURRENT AT A MAXIMUM VALUE

[75] Inventors: Klaus Buehler, Nuremberg; Bruno Doerrfuss, Herzogenaurach; Bertram Blum, Nuremberg, all of Fed. Rep. of Germany

[73] Assignee: Siemens Aktiengesellschaft, Munich, Fed. Rep. of Germany

[21] Appl. No.: 6,531

[22] Filed: Jan. 21, 1993

[30] Foreign Application Priority Data

Feb. 12, 1992 [DE] Fed. Rep. of Germany ..... 4204115

[51] Int. Cl.[5] ..... H05G 1/34

[52] U.S. Cl. ..... 378/110; 378/109; 378/91

[58] Field of Search ..... 378/108, 109, 110, 111, 378/112, 91

[56] References Cited

U.S. PATENT DOCUMENTS 4,234,793 11/1980 Amtmann ..... 378/110 X
4,246,460 1/1981 Franke ..... 378/110
4,377,748 3/1983 Aichinger et al. ..... 378/110
4,789,998 12/1988 Kuehmel .

FOREIGN PATENT DOCUMENTS 1384786 2/1975 United Kingdom .

*Primary Examiner*—David P. Porta
*Attorney, Agent, or Firm*—Hill, Steadman & Simpson

[57] ABSTRACT

An x-ray generator includes an x-ray tube voltage regulation system which automatically adapts to line impedance and fluctuations in the network voltage, so as to maintain the x-ray tube current at a maximum value. The x-ray tube current is set by the x-ray tube voltage, the x-ray tube current is regulated so that a maximally allowable line voltage drop is not upwardly exceeded. The x-ray tube current, consequently, always has its maximum value, given the prevailing circuit conditions, so that the tube power is also at a maximum value. The current is set so as to achieve a desired mAs product, which is in turn determined by the radiation dose which the operator desires.

2 Claims, 1 Drawing Sheet

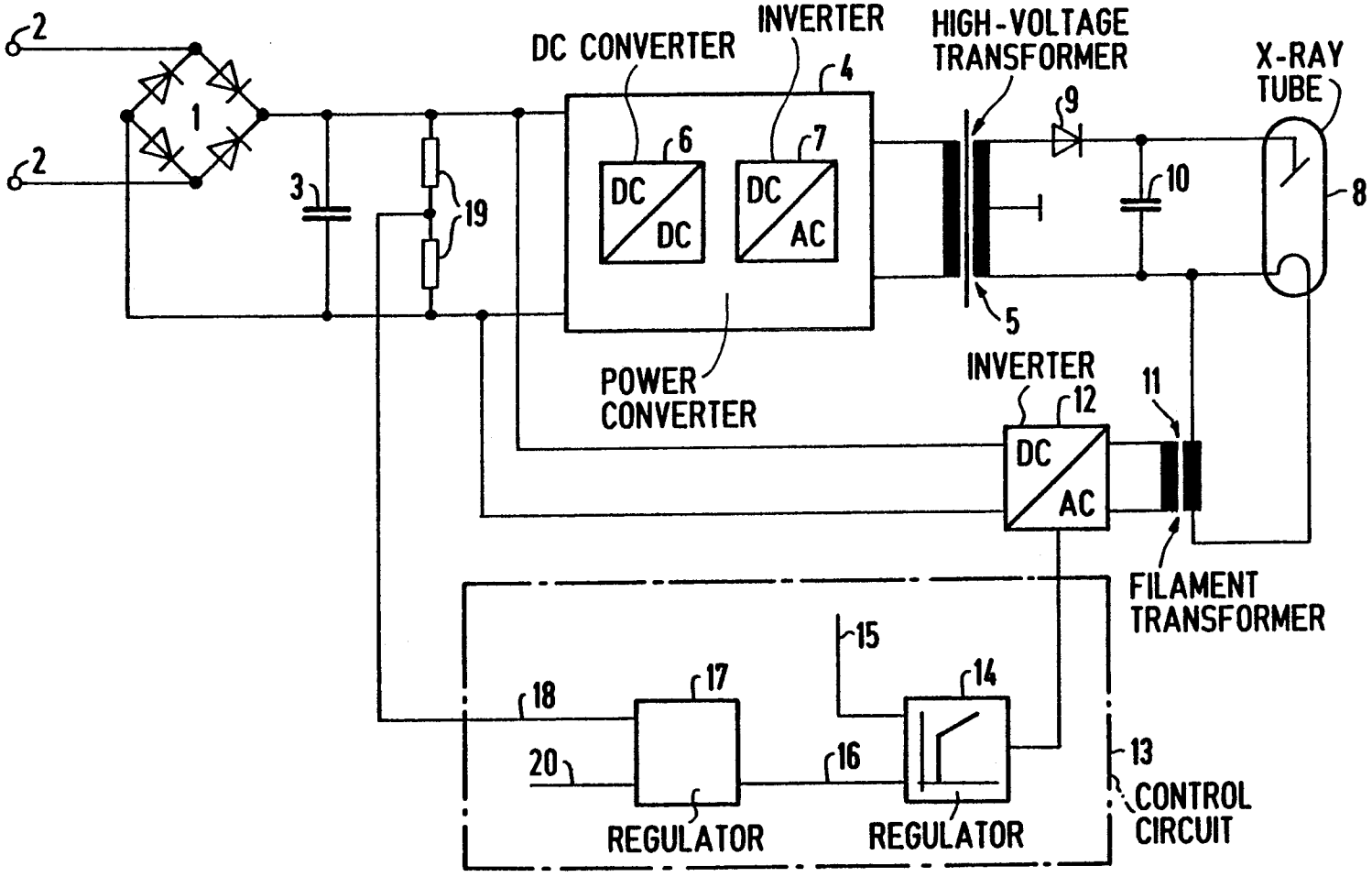
X-RAY TUBE
8
10
9
HIGH-VOLTAGE TRANSFORMER
5
INVERTER
4
7
DC
AC
6
DC
DC
DC CONVERTER
POWER CONVERTER
19
3
1
2
2
11
FILAMENT TRANSFORMER
INVERTER
12
DC
AC
13
CONTROL CIRCUIT
14
REGULATOR
15
16
17
REGULATOR
18
20

X-RAY GENERATOR WITH X-RAY TUBE VOLTAGE REGULATION FOR MAINTAINING THE X-RAY TUBE CURRENT AT A MAXIMUM VALUE

BACKGROUND OF THE INVENTION

1. Field of the Invention

The present invention is directed to an x-ray generator of the type wherein the x-ray tube voltage and the x-ray tube current are generated and regulated within the x-ray generator.

2. Description of the Prior Art

For an x-ray exposure, the x-ray tube voltage and the x-ray tube current are generated in an x-ray generator, which includes a network connected between the mains voltage and the tube. A current flows from the line to the x-ray tube, which results in a voltage drop across the line impedance. If the line impedance lies outside the specified values, or if the network experiences a significant under-voltage ("brown-out") or a high non-linear distortion factor, in known x-ray generators the voltage drop may be large enough to trigger the under-voltage monitor which is standard in such generators, thereby causing shut-down of the system. This necessitates a re-start of the system with lower power than would normally be used to create an x-ray exposure. If this situation occurs frequently, the operator must work with lower power for a significant time. Since the generation of a suitable x-ray exposure, under given conditions, usually requires a specified radiation dose, which is set by selecting a suitable mAs product. In order to achieve the same product with a lower power, a longer exposure time is needed. If the above situation arises frequently, the operator may be forced to work with lower power for a considerable time.

SUMMARY OF THE INVENTION

It is an object of the present invention to provide an x-ray generator wherein the voltage drop across line impedance, or mains voltage decreases, are automatically and continuously monitored and the x-ray tube current is set to the maximally permissible value under the prevailing conditions, so that the operator can generate an x-ray exposure with the maximum power which can be obtained under the circumstances.

The above object is achieved in accordance with the principles of the present invention in an x-ray generator having a circuit which defines an x-ray tube current such that a maximally permissible line voltage drop is not upwardly exceeded. The x-ray tube current is always automatically set so that the maximum line voltage drop which is still permissible under the current circumstances is not upwardly exceeded. The x-ray tube current, consequently, always is at its maximum value for the prevailing circuit conditions, so that the power is also at its maximum value for those conditions.

In a preferred embodiment of the x-ray generator of the invention, a control circuit for the x-ray tube current is provided wherein the rated value of the tube current is determined so that the maximum line voltage drop is not upwardly exceeded, given maximum x-ray tube power.

DESCRIPTION OF THE DRAWINGS

The single drawing is a circuit and schematic block diagram of an x-ray generator constructed in accordance with the principles of the present invention.

DESCRIPTION OF THE PREFERRED EMBODIMENTS

The x-ray generator shown in the drawing, constructed in accordance with the principles of the present invention, includes a mains rectifier 1 connected to the network via terminals 2, for example through a plug receptacle. The mains rectifier 1 is followed by a filtering or smoothing capacitor 3, and by a power converter 4, which supplies the primary winding of a high-voltage transformer 5 with alternating voltage. The power converter 4 contains a d.c. converter 6, which supplies the input voltage for an inverse rectifier (inverter) 7, the inverse rectifier 7 having an output to which the primary winding of the high-voltage transformer 5 is connected. The x-ray tube 8 is supplied with rectified high-voltage by a high-voltage rectifier 9, connected at the output of the secondary winding of the high-voltage transformer 5. This rectified high-voltage is filtered or smoothed by a high-voltage capacitor 10. The filament current for the x-ray tube 8 is supplied through a filament transformer 11, which is supplied by an inverse rectifier (inverter) 12.

The setting of the filament current of the x-ray tube 8, and thus of the x-ray tube current, ensues through a control circuit 13, which supplies a control signal to the inverse rectifier 12, for controlling the operation thereof. The control circuit 13 contains the actual tube current regulator 14, which has an input 15 supplied with a signal, obtained in a known manner, corresponding to the actual value of the x-ray tube current. The regulator 13 has another input 16, which is supplied with a signal corresponding to the nominal value of the x-ray tube current. This nominal value for the x-ray tube current is obtained from the output of another regulator 17. The regulator 17 has an input 18 which receives a signal tapped from a voltage divider 19, corresponding to the input voltage of the power converter 4. The regulator 17 has another input 20 which is supplied with a signal corresponding to the minimum value for this input voltage.

The regulator 17 sets the x-ray tube current in a manner such that the input voltage of the power converter 4, and thus the line voltage, is always at its minimal allowed value, and the x-ray tube current is thus always at its maximum value. Voltage drops which exceed a maximum line voltage drop are thus automatically prevented. The maximally possible power is consequently obtained from the network, through a broad range of internal resistances, without the maximum line voltage drop being upwardly exceeded. The reduction of the x-ray tube current for preventing an excessively high line voltage drop only minimally affects the exposure time.

The maximally allowable tube current is defined directly by a setting selected by the operator, or indirectly by the operator selecting an mAs product, which then in combination with the characteristics of the x-ray tube 8 determines the maximally allowable tube current.

The regulator 17 becomes active only when the signal at the input 18 falls below the threshold at the input 20, and thereafter regulates the rated value of the tube current relative to the input 20. The maximally prescribed tube current is thus not exceeded. The regulator 17 may be a so-called P-regulator, or PI-regulator.

The output 16 of the regulator 17 supplies a voltage value proportional to the tube current, which may be an analog voltage value, or which may be a numerical value proportional to the tube current if digital components are used. The actual value 15 of the tube current is similarly converted into a proportional voltage value or a numerical value in the tube current regulator 14.

The purpose of the regulator 17 is to insure that the consumed mains power is set, by means of regulating the tube current, so that the input voltage of the inverse rectifier 11, and thus the mains voltage, does not fall below a permissible value. The graph shown within the regulator 14 is intended to schematically indicate a regulator characteristic suitable for regulating the tube current. Input The mAs product is measured in a known manner outside of the arrangement shown in the drawing. The desired value is prescribed by the operator. The input 15 is the actual value of the tube current regulator and input 16 is the nominal value. When this desired value of the mAs product is reached, shut-off of the radiation ensues.

The automatic network matching accomplished in the generator described above achieves two important results. The voltage tapped at the voltage divider 19 is sufficiently "buffered" so that the x-ray tube regulator has sufficient time to respond to a significant voltage reduction, and therefore a corresponding reduction in the network voltage is attenuated. Additionally, the regulator is fast enough to regulate the tube current, dependent on the intermediate circuit voltage (taken at the voltage divider 19), by means of the regulator 14.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray generator comprising:

an x-ray tube operable with a tube voltage and a tube current;

a network connectable to a mains voltage for supplying said x-ray tube with said tube voltage and tube current and thereby causing said mains voltage to exhibit a line voltage drop; and regulating circuit means, connected to said network, for regulating said tube current by preventing said tube current from causing a selected maximum line voltage drop to be upwardly exceeded.

2. An x-ray generator as claimed in claim 1 wherein said regulating circuit means comprise regulating circuit means for maintaining said x-ray tube current at a rated value such that said maximum network voltage drop is not upwardly exceeded given a constant tube voltage and a selected mAs product.

* * * * *